United States Patent [19]

Sanders

[11] Patent Number: 4,852,569

[45] Date of Patent: Aug. 1, 1989

[54] PACIFIER SHIELD

[76] Inventor: Jerroll M. Sanders, 15 Riverwood Estates Blvd., Florissant, Mo. 63031

[21] Appl. No.: 151,180

[22] Filed: Feb. 1, 1988

[51] Int. Cl.[4] ..... A61J 17/00

[52] U.S. Cl. ..... 128/360

[58] Field of Search ..... 128/359, 360, 136, 150; 604/77, 75, 76

[56] References Cited

U.S. PATENT DOCUMENTS

| | | | |
|---|---|---|---|
| D. 243,366 | 2/1877 | Lybe et al. | 128/360 |
| 1,095,264 | 5/1914 | Bridges | 128/360 |
| 2,699,785 | 1/1955 | Allen | 128/360 |
| 2,834,350 | 5/1958 | Beck, Jr. et al. | 128/360 |
| 2,889,829 | 6/1959 | Tannenbaum et al. | 128/360 |
| 3,363,630 | 1/1968 | Hines | 128/360 |
| 3,653,386 | 4/1972 | Jacobus | 128/360 |
| 3,662,756 | 5/1972 | Hakim | 128/360 |
| 4,329,996 | 5/1982 | Copeland | 128/360 |
| 4,417,613 | 11/1983 | Ryan et al. | 128/360 |
| 4,640,282 | 2/1987 | Careborg | 128/360 |

*Primary Examiner*—John D. Yasko

*Attorney, Agent, or Firm*—Senniger, Powers, Leavitt and Roedel

[57] ABSTRACT

A one- or two-piece flexible shield for a pacifier nipple. The one-piece shield comprises a molded, relatively thin walled nipple cover having an opening for inserting a pacifier nipple therein to enclose the nipple, first and second retainers disposed about the interior of the shield for securing the pacifier to the shield, and a top wall disposed opposite the opening comprising at least two separate sections and adapted to be separated to expose the nipple. The two-piece shield includes a base having an opening and first and second retainers disposed about the opening for attaching a pacifier thereto and a flexible nipple cover having an opening adapted for attachment to the bottom shield to substantially enclose the pacifier and a top wall substantially the same as that of the nipple cover in the one-piece shield.

21 Claims, 2 Drawing Sheets

FIG. 3.
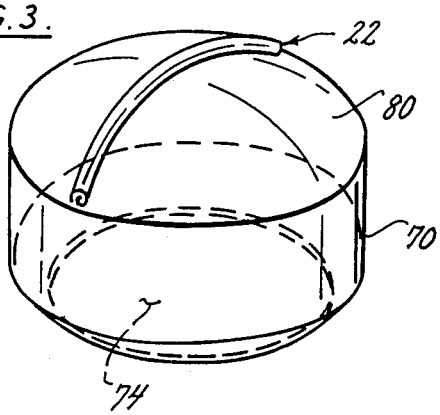
FIG. 4.
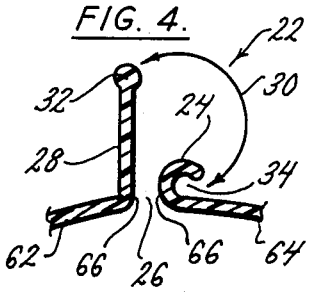
FIG. 5.
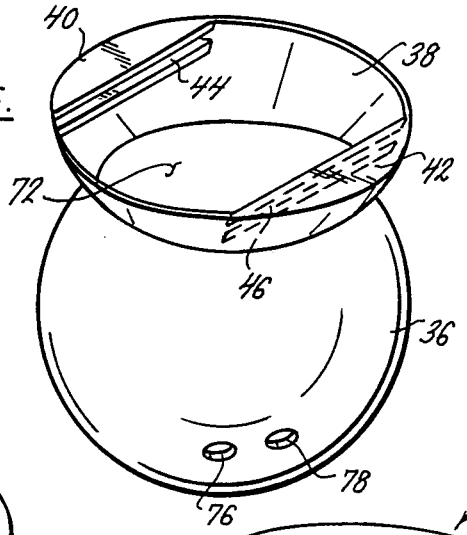
FIG. 6.
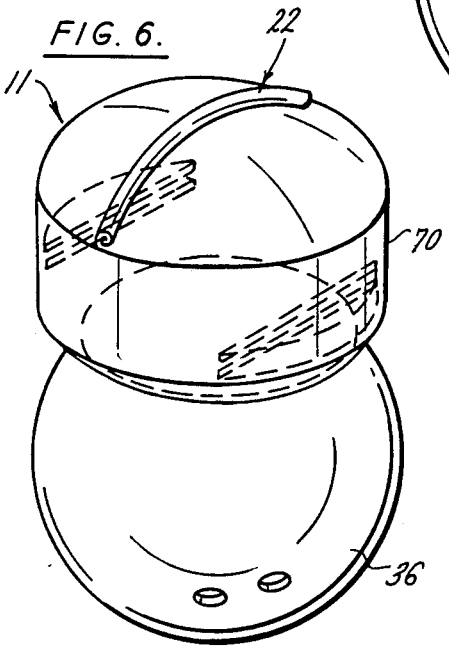
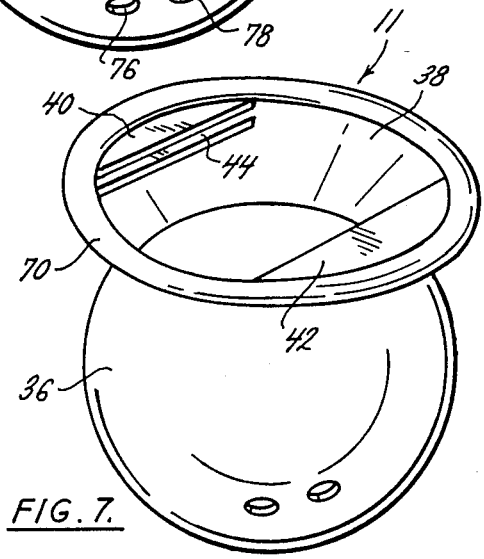
FIG. 7.

PACIFIER SHIELD

BACKGROUND OF THE INVENTION

1. Field of the Invention

The present invention refers generally to shielding devices for pacifiers, comforters and the like for infants and also to teething and similar soothing devices and, more specifically, to a shielding device which securely attaches to the pacifier for shielding pacifier nipples from dirt, dust and germs.

2. Description of the Related Art

Pacifiers, nipple-shaped devices provided for babies to suck or bite upon, are presently manufactured in various shapes and sizes. They generally include a baby size handle, a guard flange and a nipple. The nipple portion is generally shaped and sized to emulate the nipple of a nursing mother. The included guard flange, however, may be constructed in various shapes and sizes. The general purpose of the guard flange is to provide a shield sufficiently larger than the baby's mouth to prevent the baby from forcing the pacifier device completely into his mouth.

During periods of nonuse, it is very easy for germs and other foreign particles to collect on the nipple if it is resting on the baby's bed or if it is accidentally dropped on the floor. Generally, pacifiers are sold without any means for protecting the nipple from dirt, dust, other foreign particles and germs when not in use. This is particularly alarming in view of the fact that conscientious parents go through great pains to ensure that items which store the baby's formula or which are to be placed into the baby's mouth, are sterilized. When a pacifier cover is not provided, it has generally been necessary for a parent to sterilize or at the very least wash the nipple after each period of nonuse before the nipple can again be placed into the baby's mouth. The lack of a nipple shield presents the dilemma of how to adequately and safely store the pacifier and exposed nipple during the periods of nonuse when the parents are away from home or when they otherwise might not have means for sterilizing the pacifier before its next use.

An example of a prior art attempt to provide a workable device for shielding the nipple and which is mounted to the pacifier guard flange is disclosed in U.S. Pat. No. 3,363,630 issued to Hines.

The Hines device includes a spring-like collapsible shield which is placed into tension when inserted into the baby's mouth and which automatically expands upon removal from the baby's mouth to shield the exposed nipple. This shield has many significant disadvantages. For example, the disclosed shield provides limited protection against dirt, dust and germs because the shield has an enlarged open end. Also, due to the accordion like collapsibility of the spring-like shield, the shield must be attached to a pacifier which has a relatively small disc at the handle end of the nipple in order to insure proper operation. Additionally, the constant tensional pressure against the baby's mouth is highly discomforting and chaffing to the baby's lips and also gives the baby the impression that someone is always trying to remove the pacifier from his mouth. Thus, the baby resists using the pacifier and becomes upset. Also because babies suck pacifiers with varying degrees of intensity, anytime the baby stops sucking and lightly holds the pacifier in his mouth, the pacifier will be spring ejected from his mouth. Also because babies like to fall asleep with pacifiers in their mouths, the sudden ejection of the pacifier therefrom would startle the baby and awaken him before he gets into a deep sleep.

Thus the need exists for a pacifier shield which prevents the nipple from becoming contaminated and which also is securely attachable to the pacifier so as to encourage its use.

It is therefore an object of the present invention to provide a pacifier shield which is designed for easy attachment to most of the popularly used and manufactured pacifiers presently on the market.

It is another object of the present invention to provide a pacifier shield which is easily rolled upon itself to expose the pacifier nipple.

It is yet another object of the present invention to provide a universally adaptable pacifier shield which covers and protects most pacifier nipples equally well.

It is a still further object of the present invention to provide a pacifier shield which can completely enclose the pacifier including the nipple and handle.

It is a still further object of the present invention to provide a pacifier nipple shield which when attached to the pacifier, does not present a danger to the baby.

SUMMARY OF THE INVENTION

These and other objects are achieved by the present invention which provides a pacifier shield which is securely attachable to various sizes of existing pacifier guard flanges. The shield includes a flexible body for use which is easily rolled upon itself to expose the nipple for use. After periods of use the body is easily unrolled to cover the nipple. The present shield is designed for attachment to the pacifier guard flange, thus minimizing the possibility of losing the shield.

Generally, the pacifier shield of this invention comprises a molded, relatively thin-wall cover of flexible, resilient material. The cover has a top wall and an open bottom through which the nipple of a pacifier may be inserted upwardly into the cover. The shield further comprises means for releasably engaging portions of the pacifier guard flange to secure the shield in fixed position relative to the pacifier. The top wall of the cover includes at least two separate sections movable relative to one another between a closed position and an open position. In the closed position, the sections are disposed immediately adjacent one another to form, in conjunction with the remainder of the cover and the guard flange, an enclosure for the nipple substantially free of openings to protect the nipple when not in use. The sections may be rolled back upon themselves to the open position in which the sections are separated from one another to expose the nipple for use.

BRIEF DESCRIPTION OF THE DRAWINGS

FIG. 3 is a perspective view of a nipple cover of a second embodiment of the present invention;

FIG. 4 is an exploded view of a possible closure device for the present invention;

FIG. 5 is a perspective view of a base for the second embodiment of the present invention;

FIG. 6 is a perspective view of a shield in the second embodiment including a nipple cover and base; and FIG. 7 is a perspective view of the second embodiment of the present invention shown in a rolled condition to expose the pacifier nipple.

DETAILED DESCRIPTION OF THE PREFERRED EMBODIMENTS

The following detailed description is of the best presently comtemplated mode of carrying out the invention. This description is not to be taken in a limiting sense, but is made merely for the purpose of illustrating the general principles of the invention. The scope of the invention is best defined by the appended claims.

Figure 1:
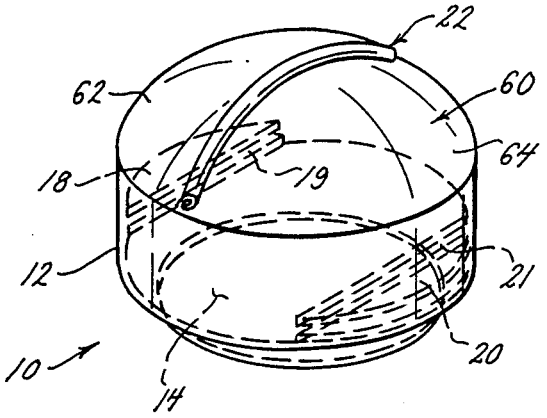
FIG. 1 is a perspective view of a nipple cover.

Referring now to FIG. 1, there is disclosed a first embodiment of the present pacifier nipple shield 10. The shield is shown as a molded, relatively thin-wall nipple cover 12 constructed of a generally durable yet flexible material, such as rubber or plastic or like materials presently known. The nipple cover 12 has an open bottom 14. Releasable means comprising retainers 18 and 20 generally at the bottom of the nipple cover which engage portions of the guard flange F of one of the many presently manufactured pacifiers to secure the shield in fixed position on the pacifier. The retainers extend radially inwardly toward one another from opposite sides of the nipple cover, adjacent to the bottom of the nipple cover. Retainers 18 and 20 are generally constructed to include slot means which in the first and second embodiments disclosed herein comprises a hollowed concave portion, or slot 19 of retainer 18 and 21 of retainer 20, into which opposite portions of the guard flange may be inserted to securely mount the shield on the pacifier. In an alternative embodiment the two separate retainers can be replaced with a continuous annular flange projecting inwardly from the wall of the shield adjacent the bottom and having a single, continuous slot in which to receive portions of the guard flange.

The nipple of the pacifier may be inserted upwardly into the cover through the open bottom 14. The cover 12 can be resiliently deformed so that the retainers 18, 20 may be moved from a first position in which they are relatively closed spaced (FIG. 1) to a second position in which they are spaced further apart (not shown). In the second position, opposite portions of the guard flange are inserted in the slots 19 and 21 respectively. The retainers are then returned to the first position in which the opposite portions of the guard flange are received in the slots for holding the pacifier in fixed position relative to the cover, with the nipple inside the cover.

Figure 2:
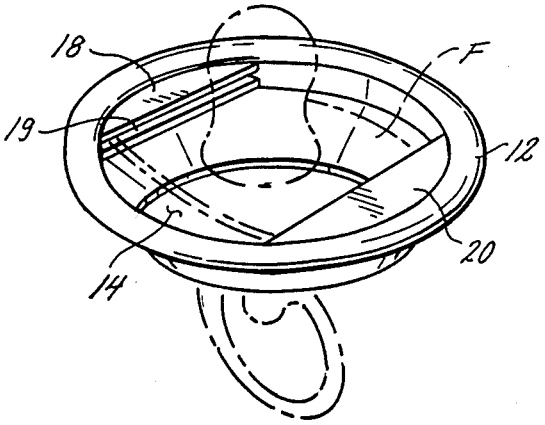
FIG. 2 is a perspective view a nipple cover in a rolled back condition engaged on a pacifier (shown in phantom)

The top wall of the nipple cover 12 indicated generally at 60, has two sections 62, 64, each of which constitute about one-half of the top wall. The sections have edges 66 (FIG. 4) extending transversely of the top wall from one side of the nipple cover to the other. The sections are movable relative to one another between a closed position (FIG. 1) and an open position (FIG. 2). The edges are generally parallel and closely adjacent one another when the sections are closed. The sections in the closed position form, in conjunction with the remainder of the nipple cover and the guard flange, an enclosure for the nipple substantially free of openings to protect the nipple when not in use. To open the sections and expose the nipple for use, each section is rolled back upon itself beginning at the edges 66. The nipple cover thus remains on the pacifier while it is in use.

FIG. 1 illustrates the present invention in an unrolled or shielding condition. Although the nipple cover 12 is shown in FIG. 1 in a generally disk-like construction, any suitable shape which allows covering of the nipple but which does not impede the subsequent rolling and unrolling, is considered to be encompassed by the present disclosure.

Referring now to FIG. 2, there is shown the first embodiment in a rolled back condition.

Fastening means, indicated generally at 22, comprises first and second fastening elements 24, 28 which are integrally formed with the top wall sections 62, 64 respectively. The fastening elements, shown in cross section in FIG. 4, run substantially continuously along respective edges of the sections, and are interengageable with one another to obtain a substantially sealing closure of the top wall. The first fastening element 24 has a socket 34 in which the head 32 of the second element 28 is receivable. To substantially sealingly close the top wall sections, the second fastening element is flexibly bent (direction indicated at 30) over the first element along the entire length of the second element so that the head is immediately adjacent the socket. The head 32 is then snapped into the socket 34 to secure the closure. The fastening means 22 are the same for all embodiments herein disclosed.

Although the present shield is shown in FIG. 1 with the optional closure device, the present shield may be designed such that the opposing edges 66 of the section 62, 64 come into contact with one another without fastening means. Also, in an alternative embodiment (not shown), one edge may overlap the other to provide for sealing the shield.

FIGS 3, 5, 6 and 7 disclose a second embodiment of the shield, generally indicated at 11, in which the shield includes a nipple cover 70 and a base 36. The nipple cover 70 of this embodiment (shown in FIG. 3) is the same as the nipple cover 12 disclosed in the first embodiment, except that there are no retainers 18, 20 in the nipple cover 70. A base 36 (shown in FIG. 5) is a hollow member molded from a flexible material and has relatively thin walls. The base is generally spherical in shape, but has a funnel shaped flange 38 surrounding an open top 72. Retainers 40, 42 extend inwardly toward one another from the upper edge of the flange 38. The retainers have slots 44, 46 identical to slots 19, 21 of the embodiment described above. The flange 38 is generally constructed from the same flexible material as the base 36. However, in an alternative embodiment, flange 38 may be less rigid than base. Retainer 40 and 42 may be constructed from flexible material or they may be constructed from a material more rigid than the base and include. The base provides protective covering from the ring or handle portion which is generally provided with known pacifiers. The base also provides an easily gripable handle for the baby and prevents the baby from harming himself with the pacifier handle.

In the second embodiment, the shield is attached to the pacifier by the retainers on the base 36, rather than the nipple cover 12 as disclosed in the first embodiment. The handle and guard flange of the pacifier are inserted downwardly into the base 36 through the open top 72. The retainers 40, 42 may then be resiliently moved apart, as described above for the first embodiment, to receive opposite portions of the guard flange in slots 44, 46 respectively. The retainers then snap together for holding the base 36 on the pacifier, with the nipple disposed above the open top 72 of the base. The nipple is then inserted up through the open bottom 74 of the nipple cover 70. The opening 74 is of relatively small size, but the nipple cover 70 may be deformed to increase the size of the opening for receiving the flange 38 of the base. The opening 74 may then be relaxed so that it returns to its relatively small size. The nipple cover 70 thus engages the flange 38 of the base 36 in the opening 74, and is held in fixed position relative to the pacifier by the base (FIG. 6). The entire pacifier is substantially enclosed by the shield of second embodiment.

The top wall 80 of the nipple cover 70 is the same in form and function as the top wall 60 of the nipple cover 12 of the first embodiment.

FIG. 7 shows the second embodiment of the present invention in a rolled back condition to expose the pacifier nipple. As shown the flexible body portion rolls back upon itself to become neatly tucked away thus providing unobstructed access to the pacifier nipple. As an alternative to rolling the body back upon itself, the user may desire to only pull the body back behind the guard flange to expose the nipple. The present device is securely and snugly attached to the guard flange portion of the pacifier and does not need to be removed by the parent. The shield is securely attached in a manner such that the baby should not be able to remove the shield from the pacifier in either its rolled or unrolled condition. Because of the flexible and conforming nature of the securing portion of the present shield, it is adaptable for use with most of the presently utilized pacifiers, and may be provided with the pacifier when sold or sold separately as an off-the-shelf product.

When in its closed position, the present shield can be utilized as an attractive, flexible and stimulating toy for the baby without risking damage to the enclosed pacifier. Also due to the flexible nature of the shield, the possibility of the baby damaging himself are minimized. If significant and nonsimilar variations exist in pacifier flanges, the present device may be constructed with a connecting mouth opening in any of the more popular known shapes, thus insuring a snug fit with a variety of pacifiers. Thus the present pacifier shield can serve to cover the sharp edges and elements of presently known pacifiers. If desired, one end of a string may be attached to the pacifier handle in one embodiment or to the base through provided holes 76, 78 in the second embodiment and the opposite end of the string may be attached to the infant's clothing, preferably with a button secured to the string. In this manner the pacifier shield with the enclosed pacifier may be secured to the infant and thus always present.

Thus, there has been disclosed a unique and novel shield for protecting baby pacifier nipples and like devices from becoming infested with dirt, dust and germs during periods of nonuse. The present device not only provides more than adequate protection against foreign objects contaminating the nipple, but is also an attractive and aesthetically appealing device which in times of nonuse may be provided safely to the baby as a stimulating toy. The present device can be used to shield the rough edges of handles on exiting pacifiers and may be sold as a separate unit or in combination with a pacifier. The one piece construction of the shield renders the present structure simple in design and inexpensive to manufacture.

It is to be understood that the above detailed description of an embodiment of the invention is provided by way of example only. Various details of design in construction may be modified without departing from the true spirit in scope of the invention as set forth in the appended claims.

What is claimed is:

1. A shield for a baby pacifier having a nipple and a guard flange, the shield comprising, a molded, relatively thin-wall nipple cover of flexible, resilient material having a top wall and an open bottom through which the nipple of a pacifier may be inserted upwardly into the cover, and means for releasably engaging portions of the pacifier guard flange to secure said shield in fixed position relative to the pacifier, said top wall of the cover comprising at least two separate sections movable relative to one another between a closed position in which the sections are disposed immediately adjacent one another to form, in conjunction with the remainder of the cover and the guard flange, an enclosure for the nipple substantially free of openings to protect the nipple when not in use, and an open position in which the sections are turned back to separate the sections from one another to expose the nipple for use.

2. The shield as set forth in claim 1 having means for releasably fastening together said top wall sections of the cover to obtain a substantially sealing closure of said sections.

3. The shield as set forth in claim 2, wherein said releasable fastening means comprises first and second interengageable fastening elements on said adjacent top wall sections of the cover in the closed position, said first fastening element having a socket and said second fastening element having a head receivable in the socket when the sections are closed thereby to form said sealing closure.

4. The shield as set forth in claim 3 wherein each top wall section constitutes about one-half of said top wall and has an edge extending transversely of the top wall from one side of the cover to the other, said edges of the sections being generally parallel and closely adjacent one another when the sections are closed, said first and second fastening elements being integrally formed with said top wall sections and running substantially continuously along respective edges of the sections.

5. The shield as set forth in claim 4 wherein said engaging means comprises retaining means adjacent the bottom of the cover on the wall of the cover defining slot means for receiving portions of the guard flange therein.

6. The shield as set forth in claim 5 wherein said retaining means comprises two retainers extending inwardly toward one another from opposite sides of the cover.

7. The shield as set forth in claim 6 wherein said retainers are adapted for resilient movement from a first position in which they are relatively closely spaced to a second position in which they are spaced farther apart to enable insertion of said opposite portions of the guard flange into said slots, and then back to said first position in which said opposite portions of the guard flange are received in said slots for holding the pacifier in fixed position relative to the cover.

8. The shield as set forth in claim 1 wherein said engaging means comprises retaining means adjacent the bottom of the cover on the wall of the cover defining slot means for receiving portions of the guard flange therein.

9. The shield as set forth in claim 8 wherein said retainers are adapted for resilient movement from a first position in which they are relatively closely spaced to a second position in which they are spaced farther apart to enable insertion of said opposite portions of the guard flange into said slots, and then back to said first portion in which said opposite portions of the guard flange are received in said slots for holding the pacifier in fixed position relative to the cover.

10. The shield as set forth in claim 1 further comprises a molded, relatively thin-wall hollow base of flexible, resilient material having a bottom wall and an open top through which the guard flange of the pacifier may be inserted downwardly into the base, the base being adapted for releasable attachment of the nipple cover thereto.

11. The shield as set forth in claim 10 having means for releasably fastening together said top wall sections of the nipple cover to obtain a substantially sealing closure of said sections.

12. The shield as set forth in claim 11 wherein said releasable fastening means comprises first and second interengageable fastening elements on said adjacent top wall sections of the nipple cover in the closed position, said first fastening element having a socket and said second fastening element having a head receivable in the socket when the sections are closed thereby to form said sealing closure.

13. The shield as set forth in claim 12 wherein each top wall section of the nipple cover constitutes about one-half of said top wall and has an edge extending transversely of the top wall from one side of the nipple cover to the other, said edges of the sections being generally parallel and closely adjacent one another when the sections are closed, said first and second fastening elements being integrally formed with said top wall sections and running substantially continuously along respective edges of the sections.

14. The shield as set forth in claim 13 wherein said engaging means comprises retaining means adjacent the top of the base on the wall of the base defining slot means for receiving portions of the guard flange therein.

15. The shield as set forth in claim 5 wherein said retaining means comprises two retainers extending inwardly toward one another from opposite sides of the cover.

16. The shield as set forth in claim 15 wherein said retainers are adapted for resilient movement from a first position in which they are relatively closely spaced to a second position in which they are spaced farther apart to enable insertion of said opposite portions of the guard flange into said slots, and then back to said first portion in which said opposite portions of the guard flange are received in said slots for holding the pacifier in fixed position relative to the cover.

17. The shield as set forth in claim 16 wherein the opening at the bottom of the nipple cover is of relatively small size, the nipple cover being adapted to be deformed at its bottom to increase the size of the opening for receiving therein a portion of the base surrounding the open top of the base, the opening at the bottom of the nipple cover thereafter being adapted resiliently to return to its relatively small size for engagement with the base thereby to attach the nipple cover to the base.

18. A shield as set forth in claim 17 wherein the base has at least one aperture adapted to receive cord means therethrough for attaching the pacifier and shield to an article such as an item of clothing worn by the child.

19. The shield as set forth in claim 10 wherein said engaging means comprises retaining means adjacent the top of the base on the wall of the base defining slot means for receiving portions of the guard flange therein.

20. The shield as set forth in claim 19 wherein said retaining means comprises two retainers extending inwardly toward one another from opposite sides of the cover.

21. The shield as set forth in claim 20 wherein said retainers are adapted for resilient movement from a first position in which they are relatively closely spaced to a second position in which they are spaced farther apart to enable insertion of said opposite portions of the guard flange into said slots, and then back to said first position in which said opposite portions of the guard flange are received in said slots for holding the pacifier in fixed position relative to the cover.

* * * * *